US005988843A

United States Patent [19]

Händel

[11] Patent Number: 5,988,843

[45] Date of Patent: Nov. 23, 1999

[54] METHOD AND DEVICE FOR CONDUCTING/ DISTRIBUTING AIR AND LIGHT

[75] Inventor: Claus Händel, Bönnigheim, Germany

[73] Assignee: LTG Lufttechnische Gesselschaft mit beschrankter Haftung, Germany

[21] Appl. No.: 08/754,236

[22] Filed: Nov. 20, 1996

[30] Foreign Application Priority Data

Nov. 30, 1995 [DE] Germany ..... 195 43 480

[51] Int. Cl.[6] ..... F21V 8/00

[52] U.S. Cl. ..... 362/576; 362/1; 362/149

[58] Field of Search ..... 362/1, 149, 576, 362/580; 359/595, 598

[56] References Cited

U.S. PATENT DOCUMENTS 1,254,520 1/1918 MacDuff ..... 359/595
4,539,625 9/1985 Bornstein et al. ..... 362/32
5,117,811 6/1992 Taylor ..... 126/428

FOREIGN PATENT DOCUMENTS 2334951 1/1975 Germany .
94 06979 3/1994 WIPO .

*Primary Examiner*—Stephen Husar
*Attorney, Agent, or Firm*—Ostrolenk, Faber, Gerb & Soffen, LLP

[57] ABSTRACT

The invention relates to a method and a device for the conducting/distributing air and light, particularly in a building, or the like. The air and light are conducted along the same transport path. That transport path may be a single duct having a light inlet and an air inlet to it and having ports at intervals along the duct, through which ports light may pass and air may pass. An air flow generating fan, or the like, may communicate with the duct for moving air through the port out of the duct or moving air through the port into the duct, or natural air flow past the duct may be used. The light source may be natural or artificial. Mirrors in the duct may be used to control brightness.

20 Claims, 15 Drawing Sheets

METHOD AND DEVICE FOR CONDUCTING/DISTRIBUTING AIR AND LIGHT

BACKGROUND OF THE INVENTION

The present invention relates to a method for conducting/distributing of air and light, particularly in a building, or the like.

It is known to conduct or distribute air either in natural flow or as mechanical ventilation by a system of ducts in order to aerate or ventilate different rooms of a building or for other reasons.

It is also known to conduct or distribute light, as daylight or artificial light by reflecting systems, for instance, to use daylight for illuminating large depths of rooms.

SUMMARY OF THE INVENTION

The object of the present invention is to improve conducting/distributing of air and light.

According to the invention, air and light are conducted along the same transport path. Thus, the transport or distribution paths for air and light are not developed separately, with a correspondingly increased expense and use of more space, but merely as a single system for transporting both air and light. The total expense is considerably reduced. For example, one duct transmits both light and air.

In a further development of the invention, light is directed in the same direction as air is transported. Alternatively, however, the direction of the light may be opposite the direction of transport of the air.

Daylight and/or artificial light are preferably used. Air is moved naturally and/or is transported mechanically.

Like the direction of the light, the transport of air can be in either direction, so that the natural movement of air can extend in the same direction as the mechanically circulated air or else in the opposite direction. The direction of light in the same direction or in opposite directions can be combined with the movement of air in the same or opposite directions, and all variants are possible with the method of the invention.

The invention further relates to apparatus for conducting/distributing air and light, in particular in a building, structure or the like. The same duct forms an air duct and a light conduction duct. The word "duct" defines a general concept of elements enabling conducting or distributing air and light. The duct can, for instance, be developed as a shaft, a pipe of any desired cross-sectional profile, etc.

In another development of the invention, air and light enter or exit a room or space through the same air/light port developed as a combined port for light and air to bring light into the room and convey air into and/or exhaust air out of the room. Depending on the size of the room or space, one or more such combined ports can be provided.

Finally, the air and light may enter the duct through the same inlet or through separate air and light inlets. Where both daylight and artificial light are light sources and, especially where there are separate inlets of air and light, the entrance of light can be again "divided up", i.e. one inlet for daylight and one inlet for artificial light. The same is true for the entrance of a natural flow of air and a mechanically circulated air flow.

Other objects and features of the invention are shown in the accompanying drawings.

DESCRIPTION OF THE PREFERRED EMBODIMENTS

Figure 1:
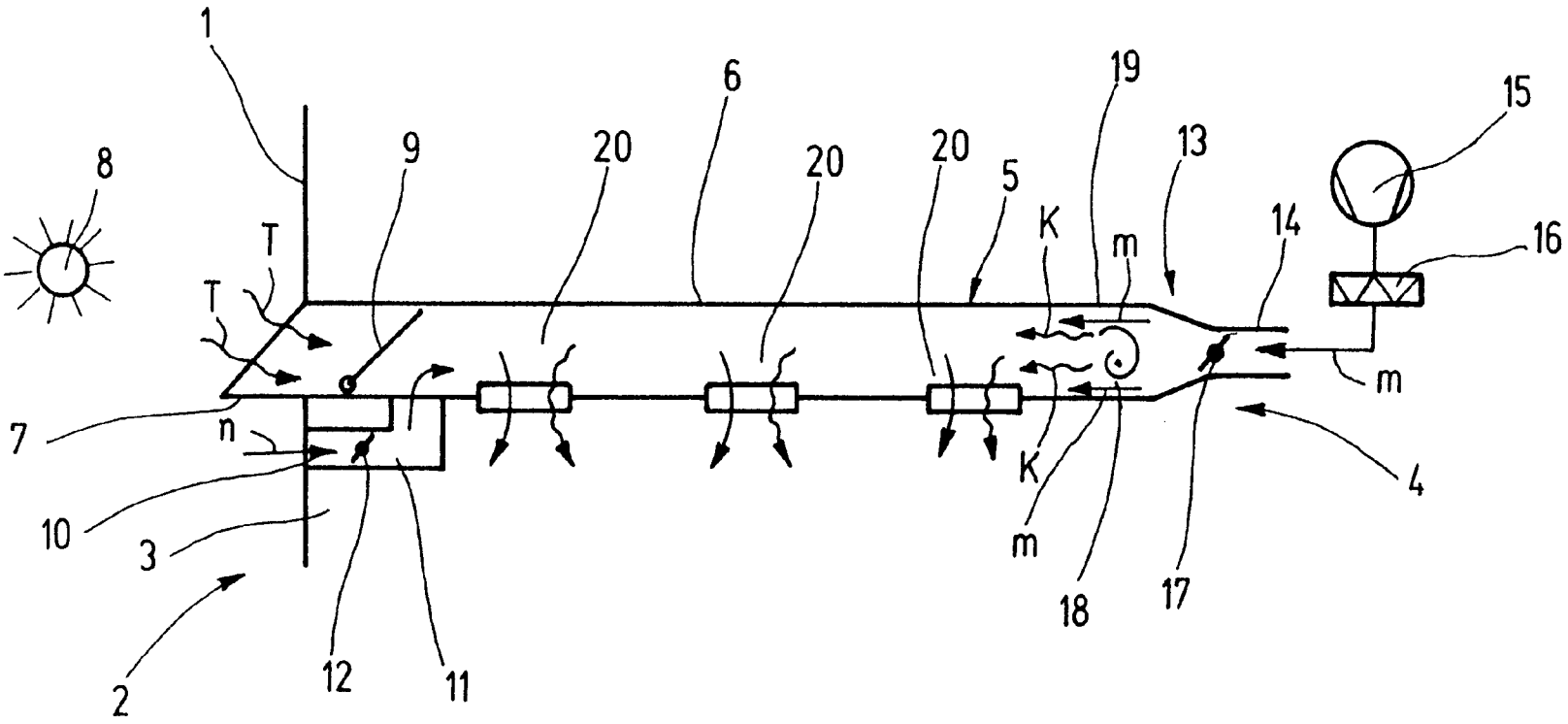
FIG. 1 is a diagrammatic view of apparatus for conducting/distributing air and light in a building.

FIG. 1 diagrammatically shows the outer wall 1 of a building 2 which has at least one room 3. In the region of the ceiling 4 of the room 3 there is a device 5 for the conducting/distributing of air and light. In this application, air flow is depicted by directional arrows on a linear or a curved course.

The arrows depicting the light are not uniformly curved or linear, but are undulated. Air arrows marked with a small n show natural movement of the air, for instance as a result of wind pressure or due to thermal movement. Air arrows marked with a small m show mechanically circulated air. Light arrows marked with a T show daylight, while light arrows marked with a K show artificial light.

FIG. 1 shows a single duct 6 which conducts both air and light. The left-hand end 7 of the duct 6 extends up to or in part beyond the front wall so that daylight from the sun 8 may enter the duct 6. Entrance of daylight can be controlled by a hingedly mounted mirror 9 which is partially reflecting. If the hinged mirror 9 is moved to close the path through the duct, no daylight enters the duct 6. If the mirror is positioned to at least partially open the path through the duct, a corresponding amount of light enters. The front wall 1 of the building furthermore has an air inlet 10 for natural flow air. The air inlet 10 opens into an elbow 11 which in turn is connected to the duct 6. An air flap 12 is within the elbow 11. Depending on the position of that flap, the elbow 11 is opened, partially opened, or closed. The elbow 11 outlets behind the hinged mirror 9 as seen along the path of daylight.

The right-hand end 13 of the duct 6 passes into an air-feed pipe 14. A fan 15 and an air treatment device 16 downstream of the fan are connected to the pipe 14. The air treatment device 16 can have a filter, heat-exchanger, humidifier, dehumidifier, air circulation and/or mixed-air flaps and/or an air conditioner. It is also possible not to provide any air treatment device 16. The air conveyed by the fan strikes an air flap 17, which influences the flow depending on the position of the air flap 17, and the air then enters the duct 6. The natural movement of air within the duct 6 is opposite the direction of mechanically conveyed air.

Furthermore, in the right-hand end 13 there is a source of artificial light 18, for instance, a high pressure discharge lamp or any other conventional source of light preferably with a directed light beam. Preferably, the artificial light source has a light deflection mirror 19 which properly directs the light into the duct 6. The daylight direction in the duct 6 is opposite the artificial light direction.

The duct has several air/light ports 20 along its side from which air and light emerge and through which air and light may enter, for instance, the room 3 of the building 2 where the duct is located.

To enable the duct 6 to conduct light, its walls are developed as mirror walls. For example, the walls support a light reflecting foil, particularly a foil with a prism grid. Alternatively, the walls of the duct can also have a prism structure with a light reflecting action on their surface.

Figure 17:
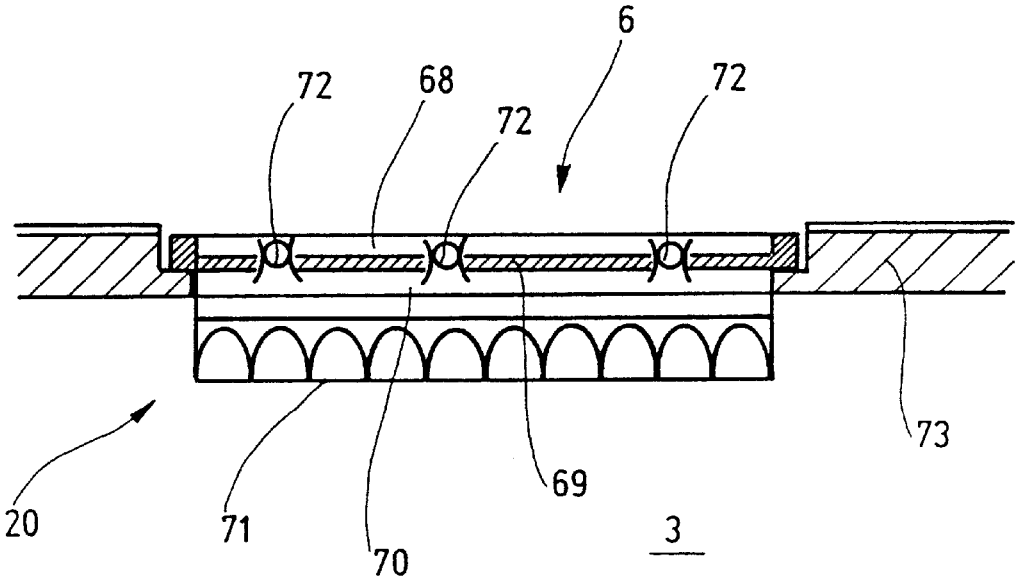
FIG. 17 shows a third embodiment of a combined air port for air and light.

Each air/light port 20 is preferably provided with a sandwich plate. From inside to outside the port, the plate has a clear glass pane, followed by a light transmitting foil, preferably a prismatic foil, which is followed by a light-deflection grid or the like. FIG. 17 shows this in detail.

Figure 2:
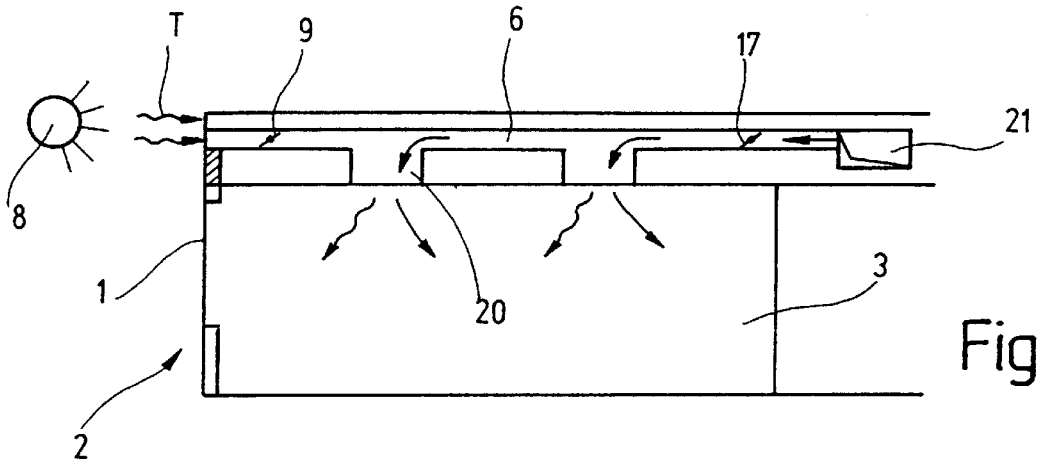
FIG. 2 shows a side view of a first embodiment of an air/light feed into a room.
Figure 3:
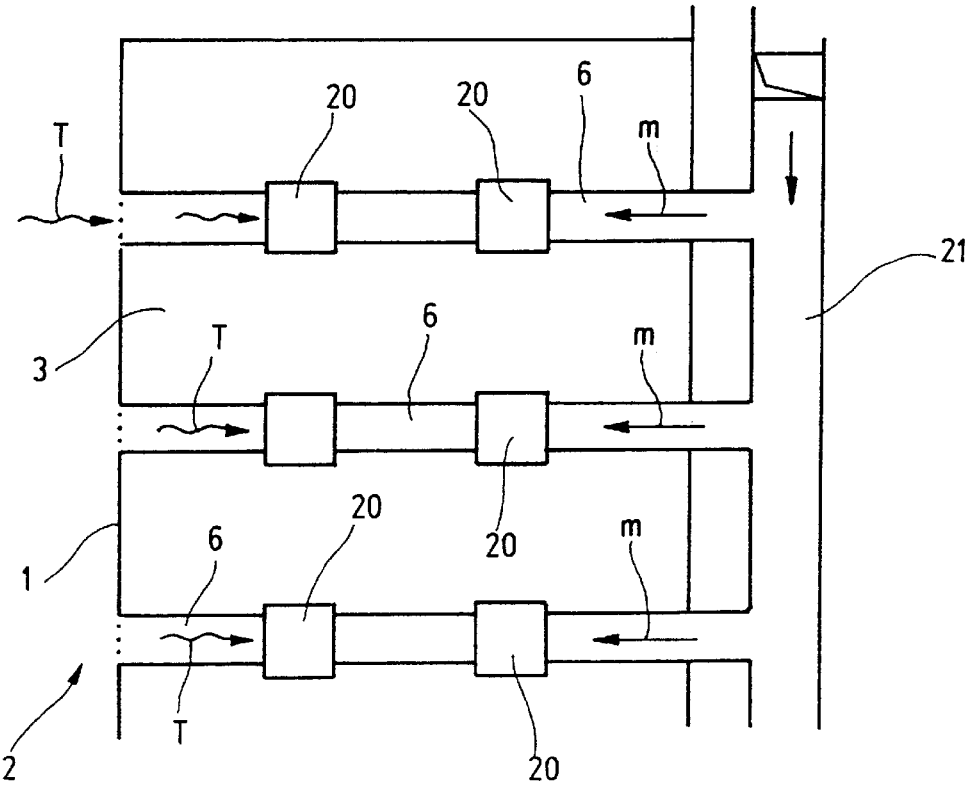
FIG. 3 shows a top view of the room of FIG. 2.

FIGS. 2 and 3 schematically show a room 3 of a building 2 having an air feed duct 21 in the region of the ceiling. Several ducts 6 branch off from the main duct in a parallel array. The ducts 6 conduct air/light. Daylight enters at the front wall 1. It enters the corresponding ducts 6 in the region of the one end of the ducts 6. Each duct 6 has several air/light ports 20 which distribute the air/light into the room 3. As an alternative, instead of feeding in air, an exhaust air device can be provided, i.e. the air/light ports 20 conduct light into the room 3 but remove air from the room 3, i.e. the air arrows in FIGS. 2 and 3 would be directed opposite to the arrows shown. As in FIG. 1, hinged mirrors 9 and air flaps 17 are provided, but for simplicity are shown only in FIG. 2 and not in FIG. 3.

Figure 4:
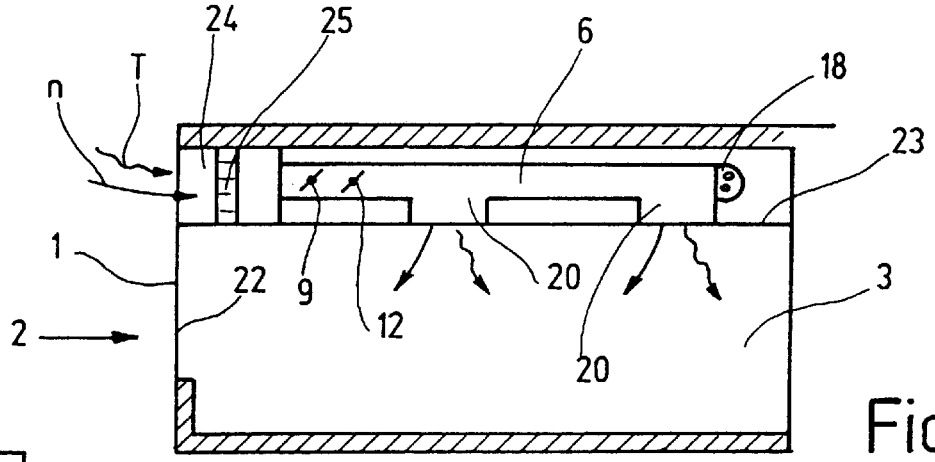
FIG. 4 shows a side view of a second embodiment of an air/light feed into a room.
Figure 5:
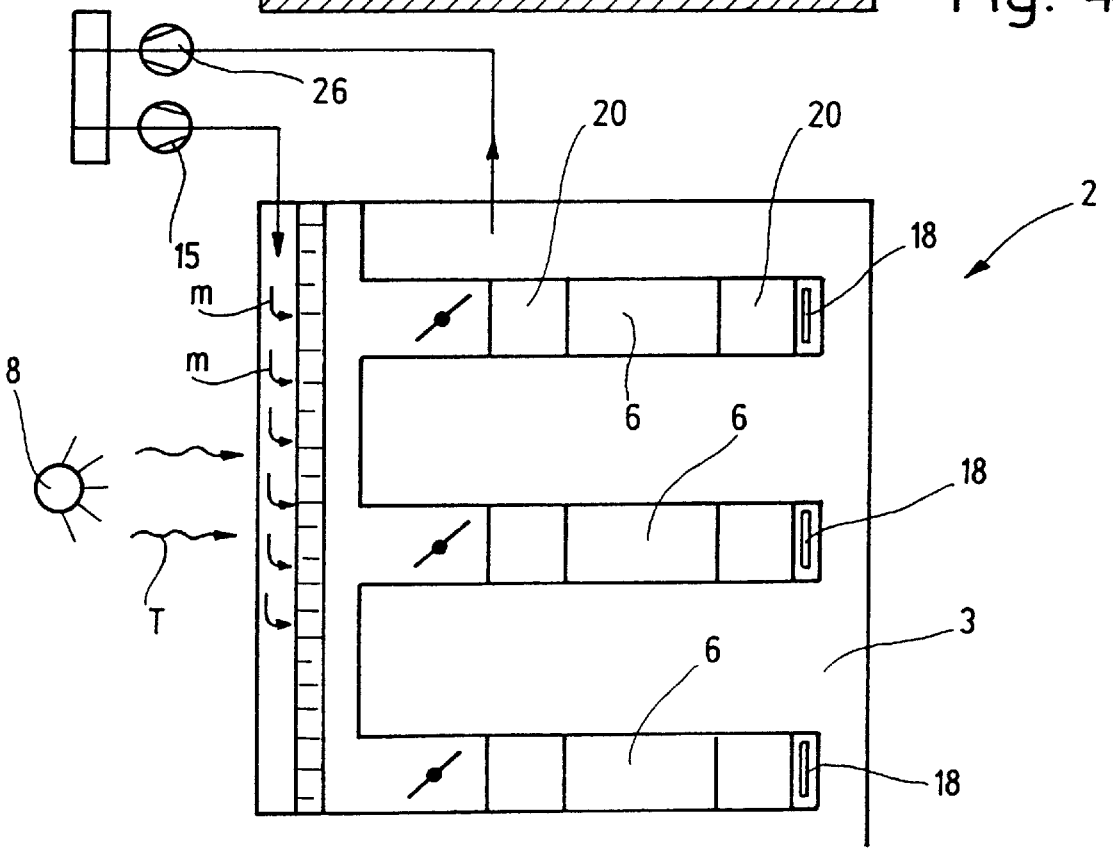
FIG. 5 shows a top view of the room of FIG. 4.

FIGS. 4 and 5 show a room of a building 2 which has a front wall 1 of glass. Daylight enters the room 3 through the front wall 1 which acts as a window 22. The room 3 has a suspended ceiling 23. A chamber 24 which contains transparent heat insulation 25 is located above the suspended ceiling in the region of the front wall 1. As an alternative, this installation may be a visible one below the concrete ceiling. The heat insulation 25 permits light to pass, but impedes the conduct of heat. Furthermore, it is permeable to air. Daylight passes through the glass front wall into the chamber 24 and penetrates through the heat insulation. It thereby arrives in the duct 6 which is in communication with the chamber 24.

Furthermore, air, preferably with natural movement, enters the chamber 24 through suitably shaped glass front wall elements. That air also passes through the heat insulation 25 to also arrive at the left end of the duct 6. A hinged mirror 9 and an air flap 12 are arranged there, so that the air and the light can be controlled. These two flaps are shown merely diagrammatically in FIG. 4. In the same way as in FIG. 1, the air path is developed by a separate duct, in particular an elbow 11. Air and light pass via the duct 6 to air/light ports 20 through which they both can enter the room 3. A source of artificial light 18 in the region of the right end of the duct 6 introduces artificial light into the duct 6 so that the room 3 can be provided with daylight, artificial light or with a mixture of both.

In FIG. 5, it is also possible for the front wall 1 of the building, comprised of glass, to be closed so that no air can enter there. In that case, air is introduced into the region of the chamber 24 between the front wall 1 and the heat insulation 25 by a fan 15. The air flows through the heat insulation 25 to arrive at the ducts 6. Exhaust air is removed from the room 3 by a separate fan 26 communicating through an exhaust duct.

Figure 6:
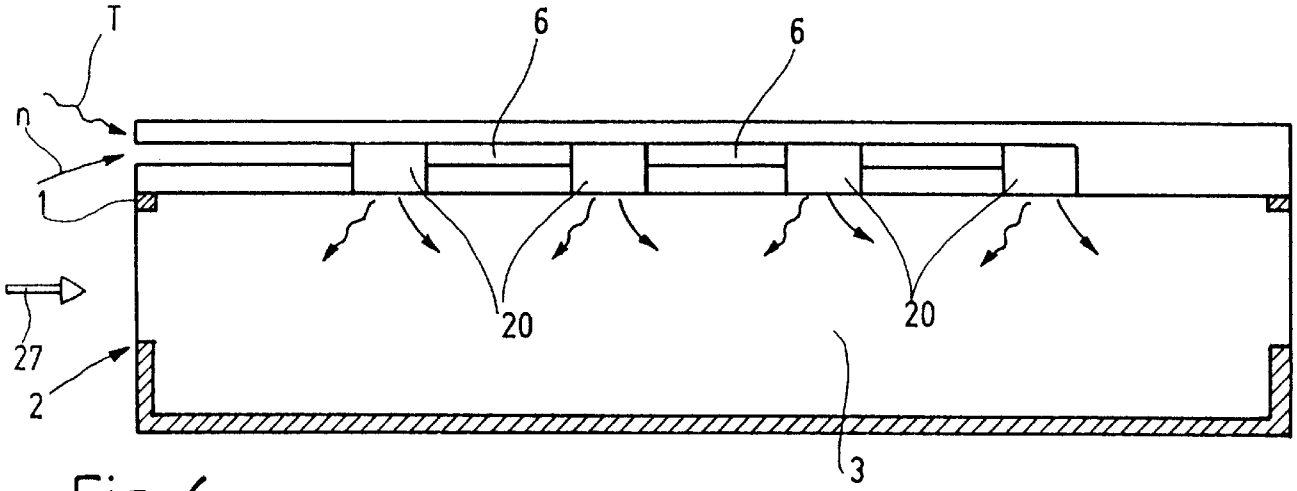
FIG. 6 is a side view of a third embodiment of an air/light feed into a room.
Figure 7:
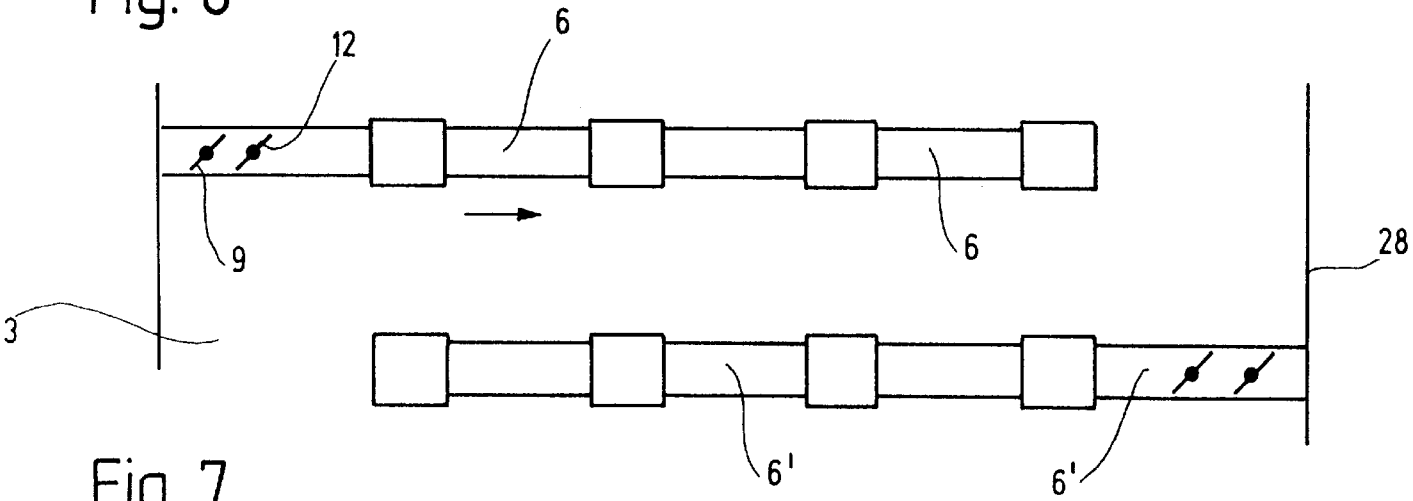
FIG. 7 is a top view of the room of FIG. 6.

FIGS. 6 and 7 show a room 3 which has the duct 6 in the region of the ceiling, and where daylight enters from the front wall 1 of the building 2 into the duct 6. Furthermore, wind pressure 27 acts on the front wall 1 so that air enters the duct 6 with natural air movement. In FIG. 6, this causes both air and light to emerge from the air/light ports 20. FIG. 7 shows a duct 6, corresponding to that in FIG. 6, extending from the leeward or rear side 28 of the building 2 and extending up to a short distance from the front wall 1. Two different ducts 6 and 6' are formed. The duct 6 opens on the windward front side 1 of the building, while the duct 6 opens on the leeward rear side 28. Exhaust air from the room 3 is conducted outward from the duct 6' because its leeward position creates a vacuum in that duct. Air from the room 3 enters the corresponding air/light ports 20 connected to the duct 6' and is discharged from the duct 6'. The duct 6' also conducts light from the leeward side of the building via the duct 6' into the room 3. Several ducts 6 and 6' can be provided in a room, arranged alternately one after the other.

Figure 8:
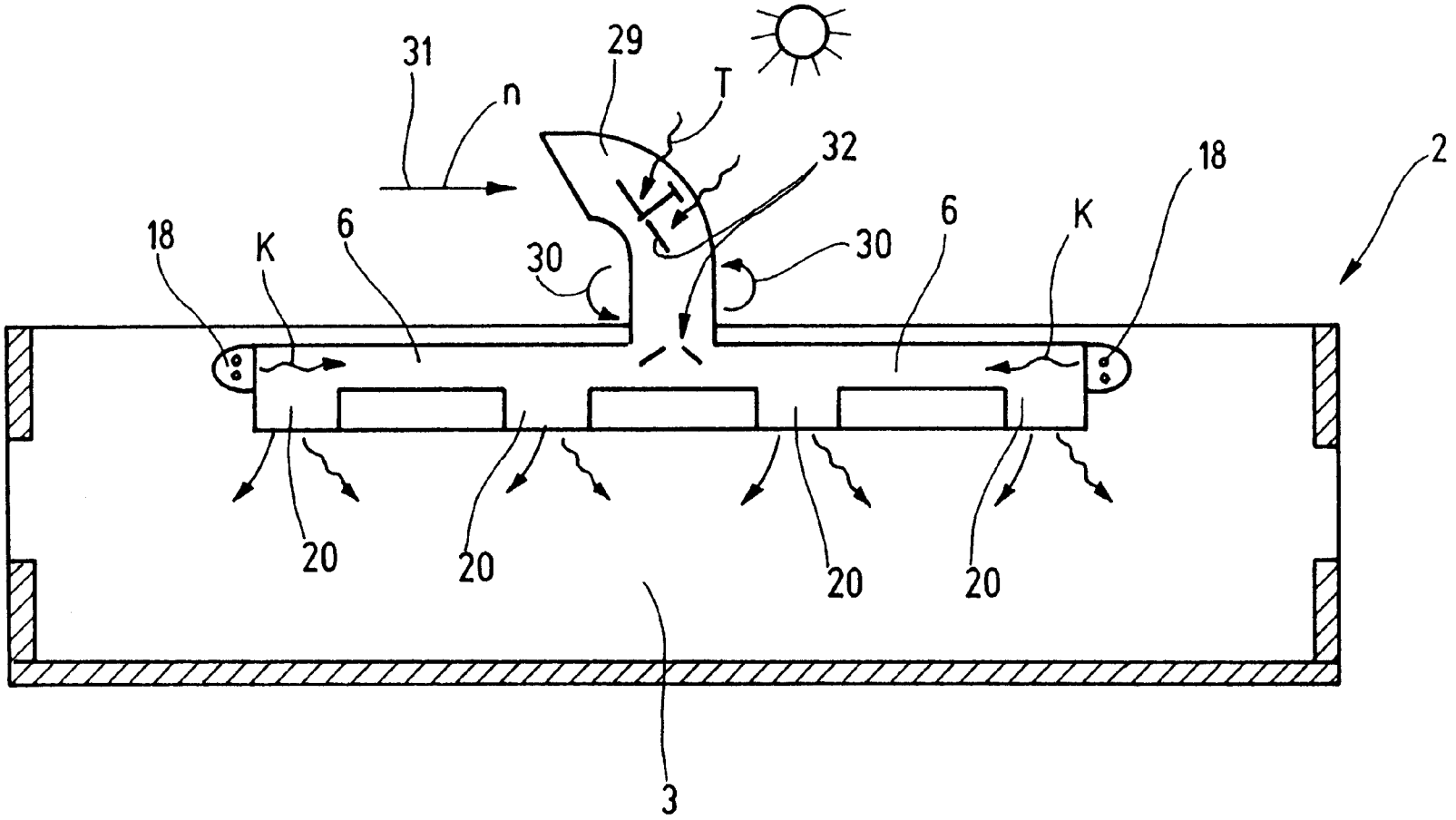
FIG. 8 is a side view of a fourth embodiment of an air/light feed into a room.

FIG. 8 shows a room 3 of a building 2 which has a duct 6 in the region of its ceiling. The duct has several air/light ports 20. There are sources of artificial light 18 at the ends of the duct, whereby artificial light is introduced into the duct 6. The duct 6 is further connected with a scoop 29 arranged on the roof of the building 2. The scoop 29 can be turned around its longitudinal (vertical) axis (arrows 30) enabling wind 31 to enter the opening of the scoop 29 and to pass into the duct 6 to the ports 20. The roof or top of the scoop 29 is transparent so that daylight can enter into the scoop 29 and be directed by a system of mirrors 32 to the duct 6. In FIG. 8, air and light are fed to the room 3 by the duct 6. As an alternative, it is possible to deliver light through the duct 6 but to remove air through it by aligning the scoop 29 by rotating its opening to the leeward direction, producing a vacuum. Air is discharged from the room 3 via the duct 6 and the scoop 29. Nevertheless, daylight is still fed via the duct 6 and the ports 20 into the room 3.

Figure 9:
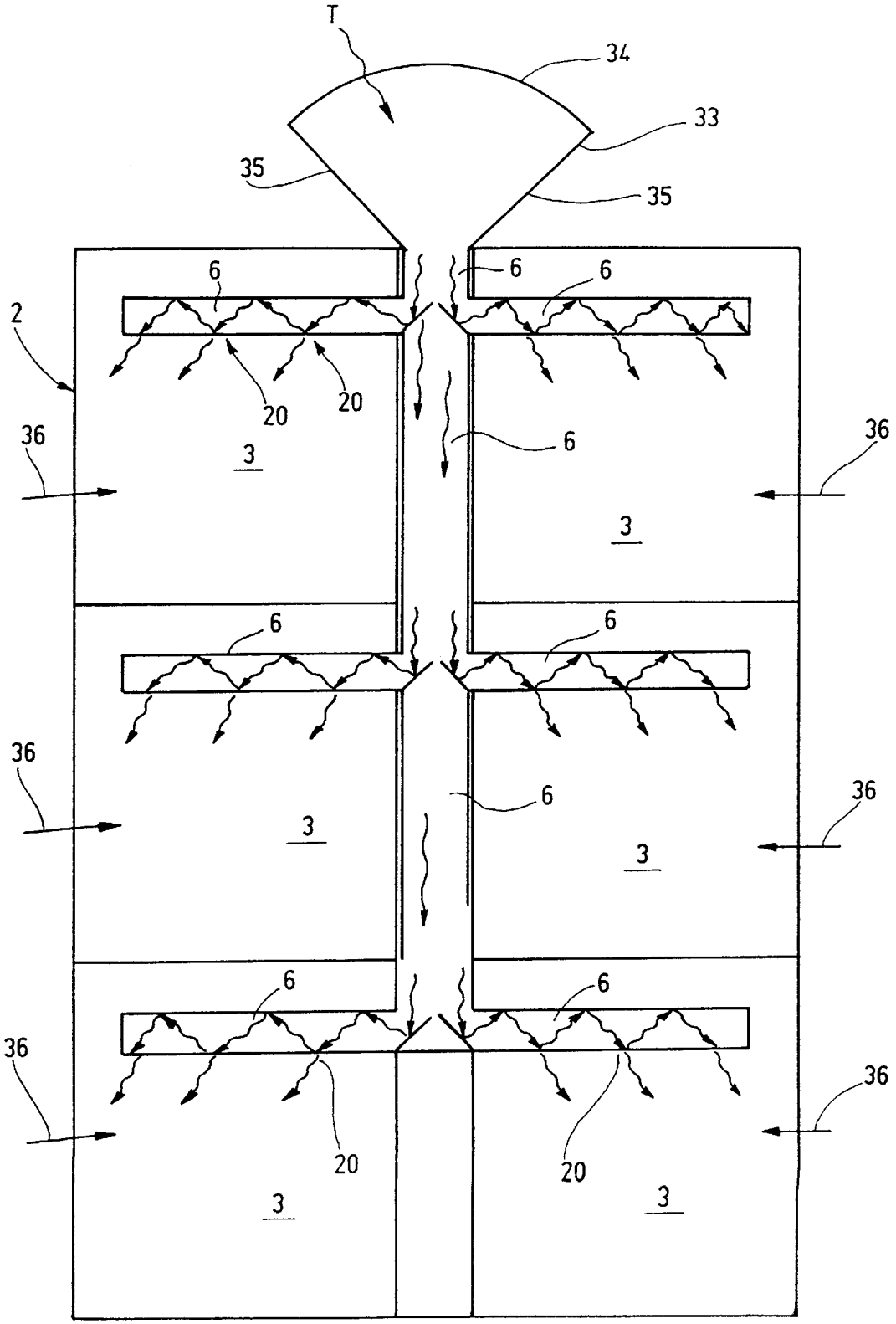
FIG. 9 diagrammatically shows a building having a fifth embodiment of an air/light conduction system.

FIG. 9 shows a building 2 having several rooms 3. Each room 3 has a horizontal duct 6 in the region of its ceiling. The individual ducts 6 are connected to each other by vertical ducts 6. A funnel 33 in the region of the roof of the building 2 supports a glass cupola 34. Daylight passes through the glass cupola 34 and enters the vertical duct 6. Light is directed into the horizontal ducts 6 where it then emerges through air/light ports 20, not shown here in detail. The ports 20 take up exhaust air, i.e., the room air of the rooms 3 passes into the corresponding duct 6 and, via the central vertical duct 6 through chimney-like action, is conducted up into the funnel 33 which has air-outlet openings 35. The feed air fed to the rooms 3 is indicated schematically by arrows 36. It is fed to the rooms 3 and is preferably suitably treated in conventional manner.

Figure 10:
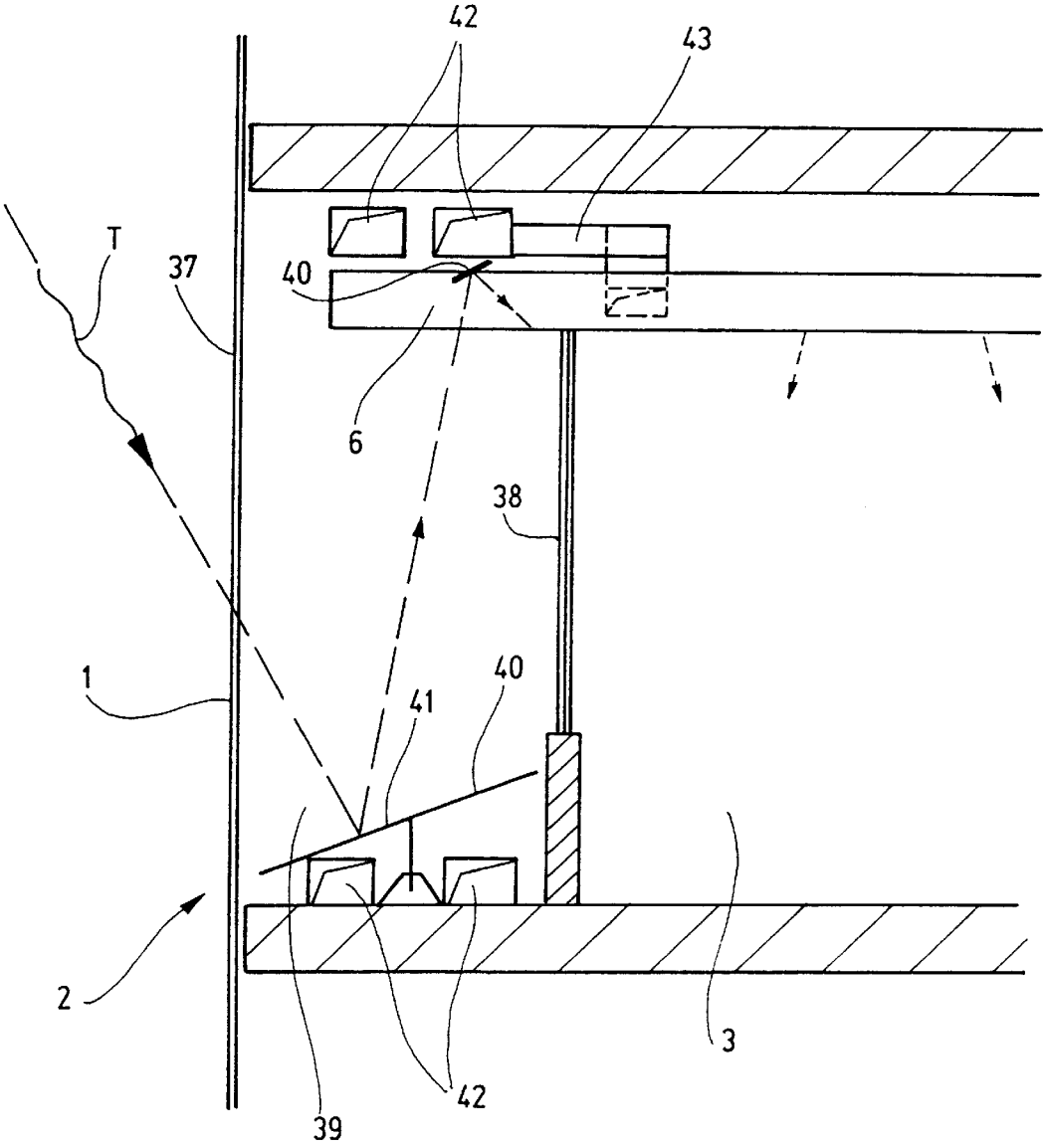
FIG. 10 is a detail view of a sixth embodiment of an air/light feed.

FIG. 10 shows a building 2 in the region of its front wall 1. The front wall 1 is developed as a double front wall, i.e. it has a front facade 37 and a rear facade 38 further to the inside. Both facades 37 and 38 are light transmitting. There is a mirror device 40 in the intermediate chamber 39 between the front facade 37 and the rear facade 38. That device is preferably trackable, i.e. its orientation may be varied as a function of the position of the sun. Daylight passes through the front facade 37 into the chamber 39 and is reflected by the mirror elements 41 of the mirror device 40 to the duct 6 at the region of the ceiling of a room 3 of the building 2. Daylight entering the duct 6 can be introduced above into the room 3 as already described. Feed air and/or exhaust air are fed and removed respectively by central systems 42. These air devices are connected via airways 43 with the duct 6.

Figure 11:
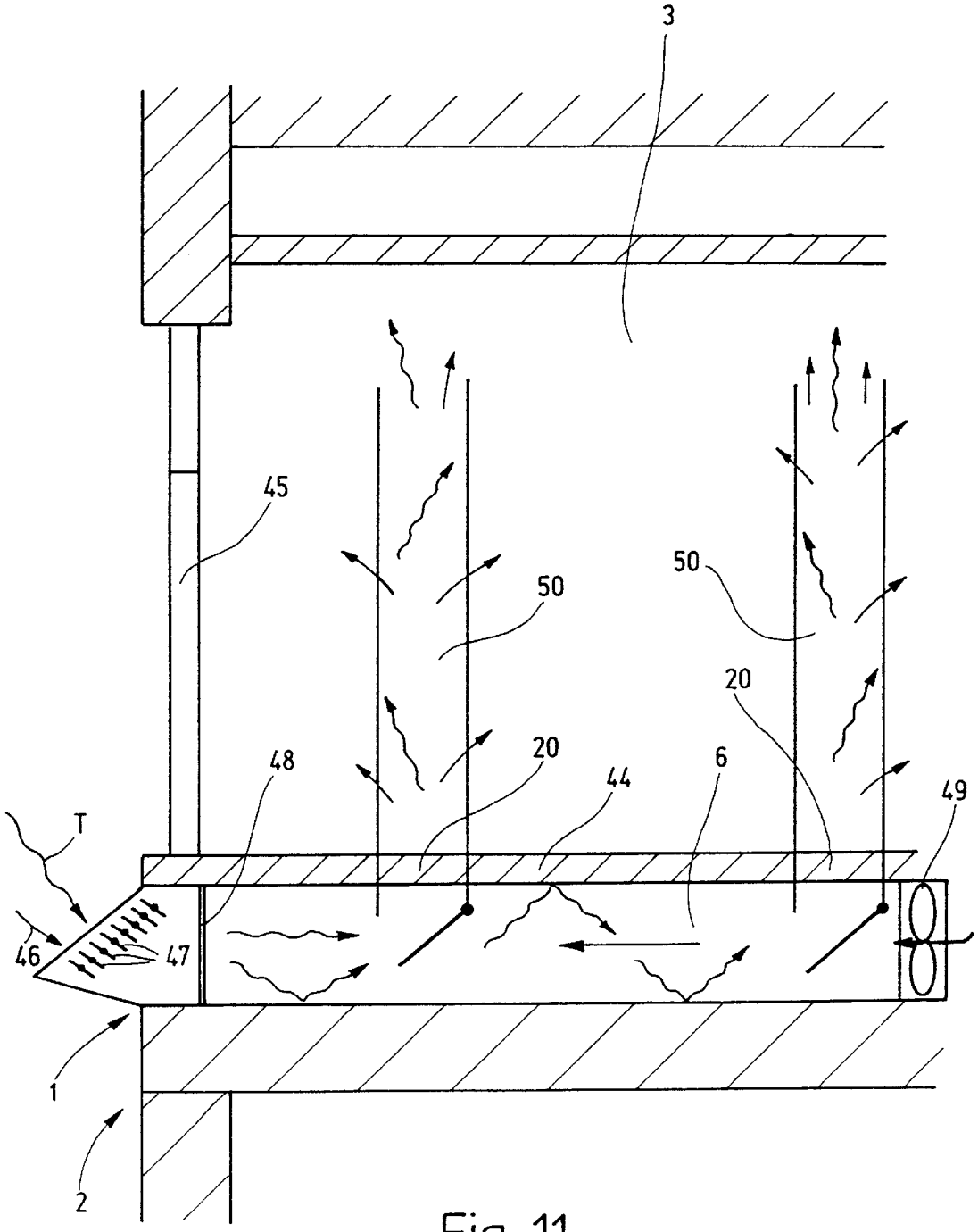
FIG. 11 is another detail view of a seventh embodiment of an air/light feed.

FIG. 11 shows a room 3 of a building 2 which has a double floor 44. The room 3 has an insulated glass front 45 in the region of its front wall 1. There is a light inlet 46 for daylight T at the front wall 1 in the region of the double floor 44. Daylight is introduced into the region of the double floor 44 preferably by moveable light deflection elements 47. The light inlet 46 is shut off from beneath the top part of the double floor 44 by a glass plate 48 so that, while light can enter, no air can emerge. At another place along the double floor 44, there is a fan 49, or an air-feed line inlets there, introducing air into the double floor 44. The entire region of the double floor is developed as a duct 6, i.e. either the entire space below the top of the double floor 44 conducts air and light or individual ducts are included therein. It is possible for light and air to enter the room 3 in the region of the floor. Air and light columns 50 are developed at different places in the room 3. For enabling entrance of air and light into the room 3, air/light ports 20 are arranged in the floor of the room 3.

Figure 12:
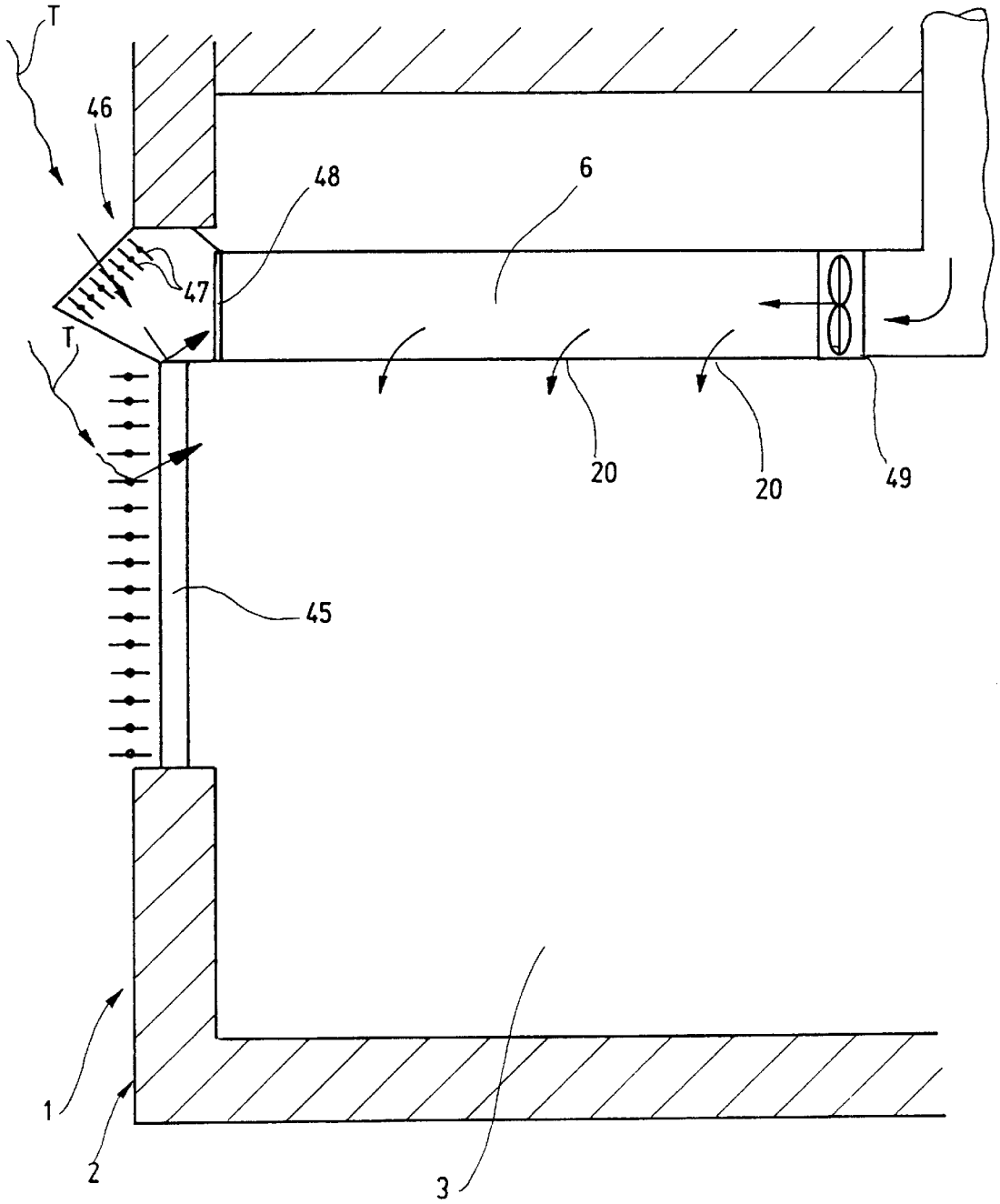
FIG. 12 is another detail view of an eighth embodiment of an air/light feed.

FIG. 12 shows a development which corresponds to FIG. 11, but in which the duct 6 is not contained in a double floor, but instead is in the region of the ceiling of the room 3.

Figure 13:
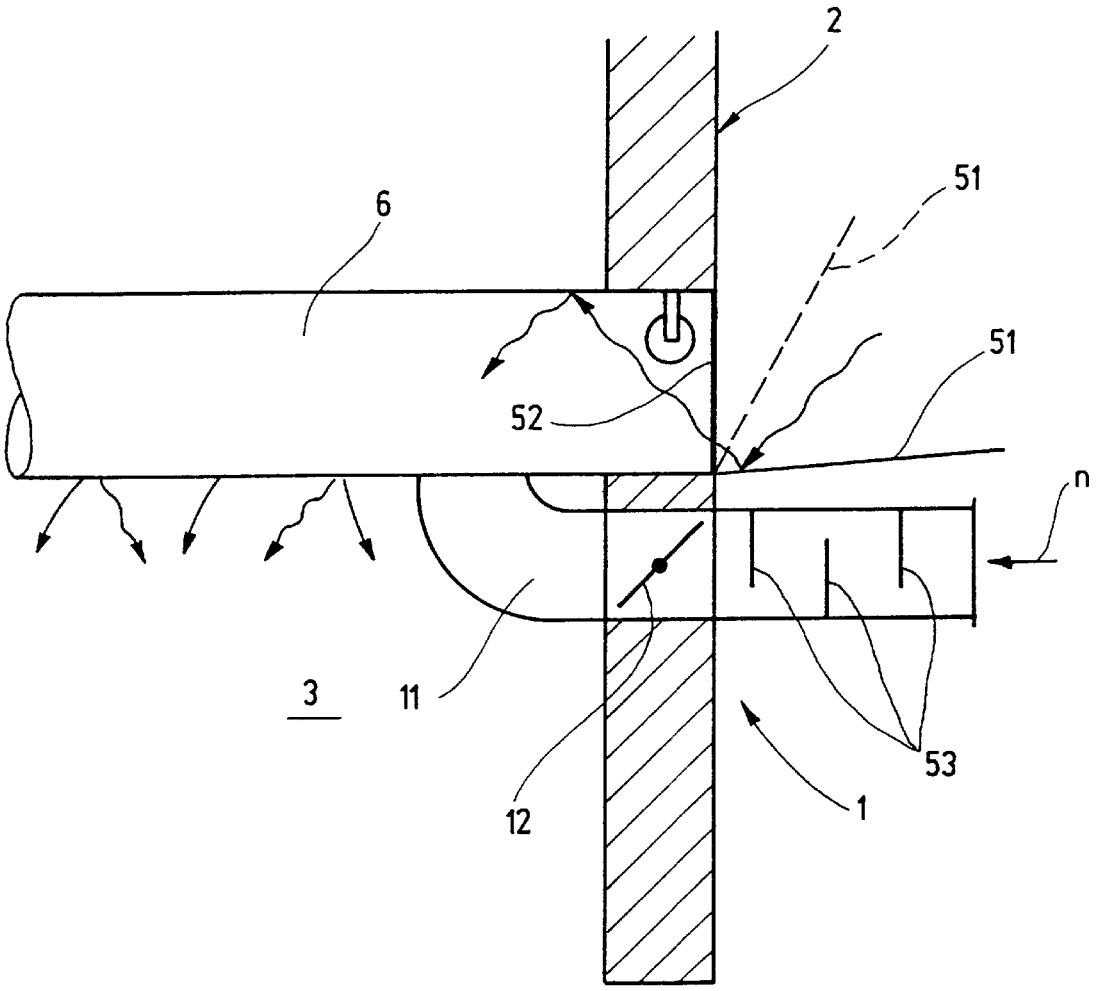
FIG. 13 is another detail view of a ninth embodiment of an air/light feed.

FIG. 13 shows a region of a front wall 1 of a building 3 which has at least one room 3. There is a duct 6 in the region of the ceiling of the room 3. A swingable mirror 51 extends from the front wall end of the duct 6. It is shown in solid line in a widely swung open position and in broken line in a further closed position. The swinging mirror 51 regulates brightness depending on its angular adjustment to introduce a corresponding amount of daylight into the duct 6. The duct 6 is closed off by a light-transmitting device 52, for instance a glass plate, preventing air from emerging from the duct. Air, for instance natural air movement, is fed through an elbow 11 which is provided with an air flap 12. A part of the elbow 11 extends out beyond the front wall 1. A sound absorber 53 is in the elbow. The duct 6 can be provided, for instance, with air/light ports 20 or else act like a "thick neon tube", i.e. it is transparent to light at least in regions and has a perforation so that it acts as source opening for the air.

Figure 14:
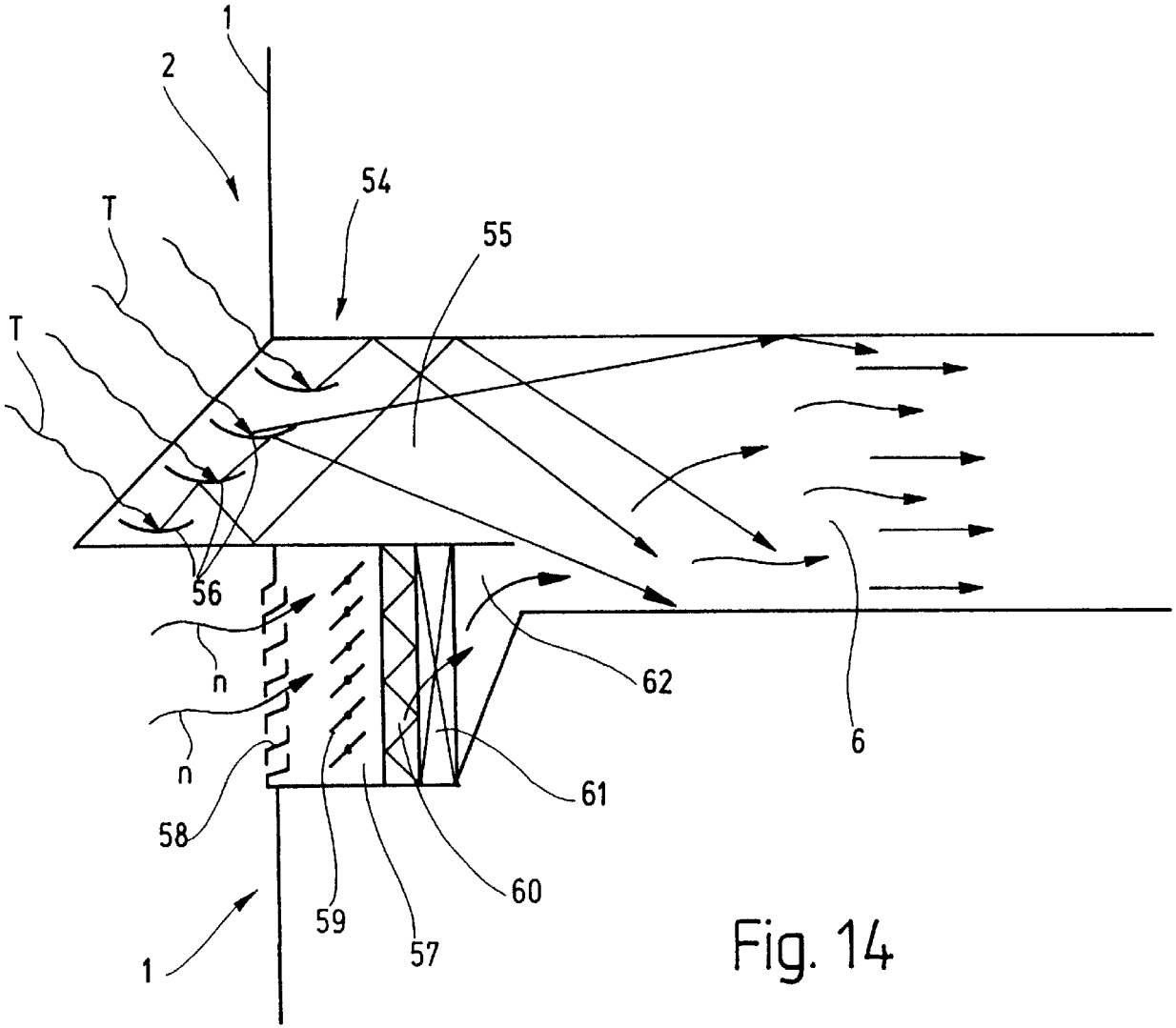
FIG. 14 is another detail view of a tenth embodiment of an air/light feed.

FIG. 14 shows an air/light inlet 54 in the region of a front wall 1 of a building 2. This air/light inlet 54 has a light guide region 55 which is provided with curved individual mirrors 56, which enable daylight to optimally enter the light conduction region 55. There is an air inlet 57 below the light conduction region 55. It has an air inlet grid 58 in the region of the front wall 1. A flap or venetian-blind slat 59 is behind the grid 58, followed by an air filter 60, followed by a heater or cooler 61. This is followed by a feed duct 62 which, together with the light guide region 55, opens into the duct 6.

Figure 15:
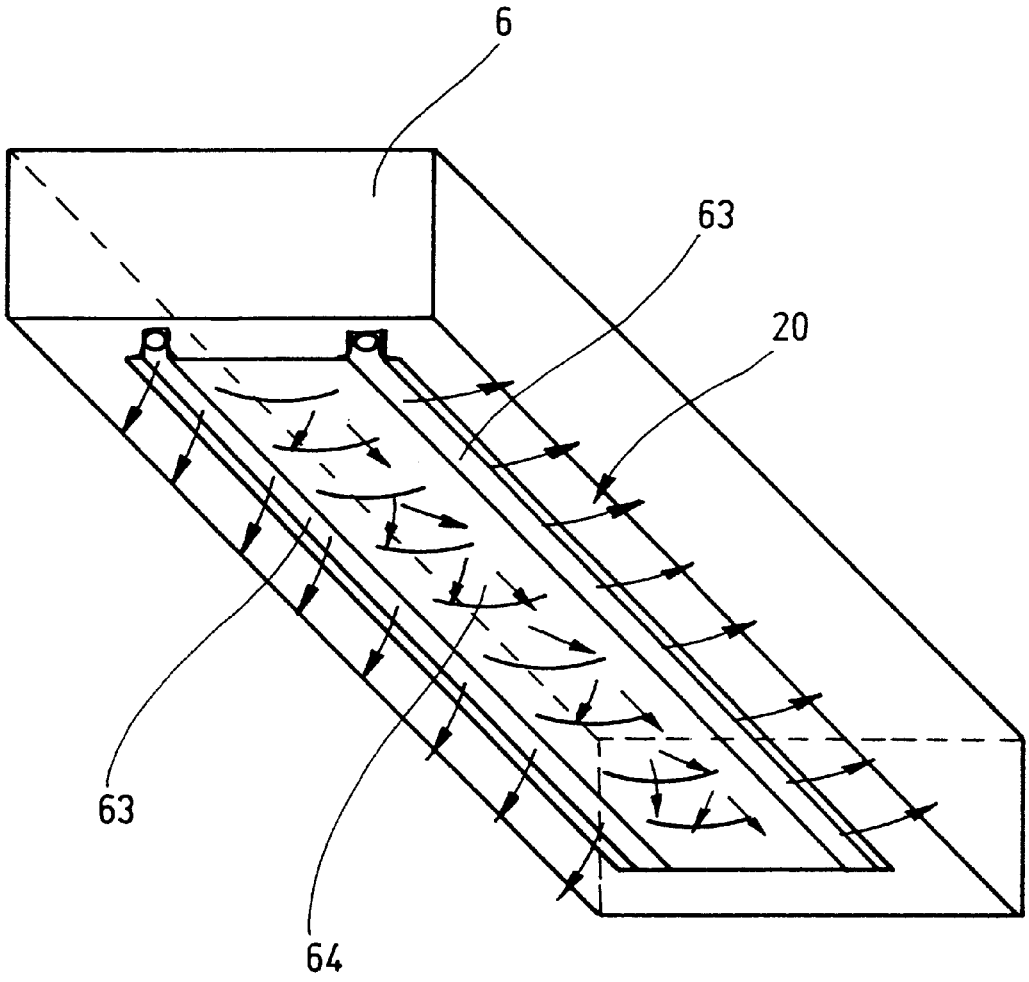
FIG. 15 shows a first embodiment of a combined air port for air and light.

FIG. 15 shows an air/light port 20. The duct which feeds light and air is developed above the port 20. The air/light port 20 can be arranged flush in the ceiling of a room, or else may protrude below the ceiling. The air passes out, preferably through slit outlets 63, which, as seen over their length, adjoin the air outlet 64. The duct 6 is preferably fed daylight and natural air in the one direction and artificial light and primary air, i.e. mechanically moved air, in the other direction. This feed can, however, also be effected in some other combination.

Figure 16:
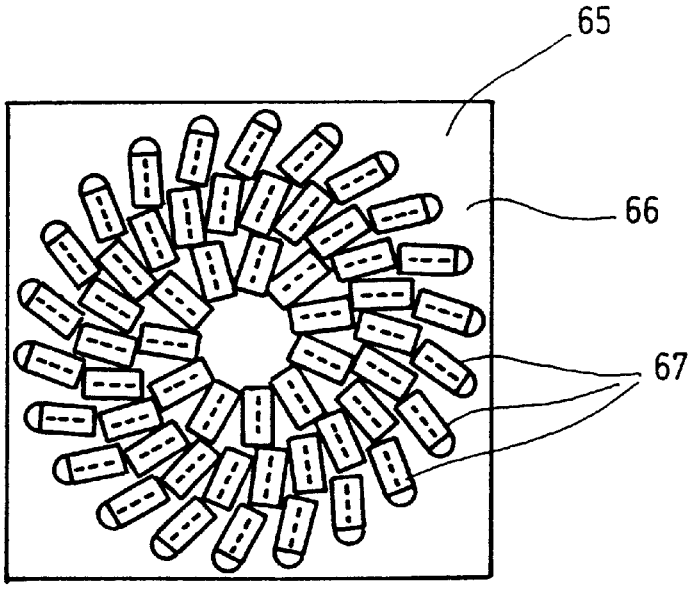
FIG. 16 shows a second embodiment of a combined air port for air and light.

FIG. 16 shows an air/light port 20 which is like a ceiling plate 65 and is developed as a glass plate 66 enabling light to enter the room 3 there. The glass plate has a plurality of air outlets 67 through which air is fed into the room 3 but which can also serve as exhaust outlets.

FIG. 17 is a cross section through an air/light port 20. From top to bottom, there is a clear glass plate 68 which faces the inside of the duct 6. It is then followed outward by a so-called prismatic foil 69 and then, in turn, by a glass plate 70 which can be vaporized. Next is a light and air deflection grid 71. Air deflection elements 72 enable air to penetrate through the different glass plates and the foil and permit air to pass from the duct 6 into the room 3.

Figure 18:
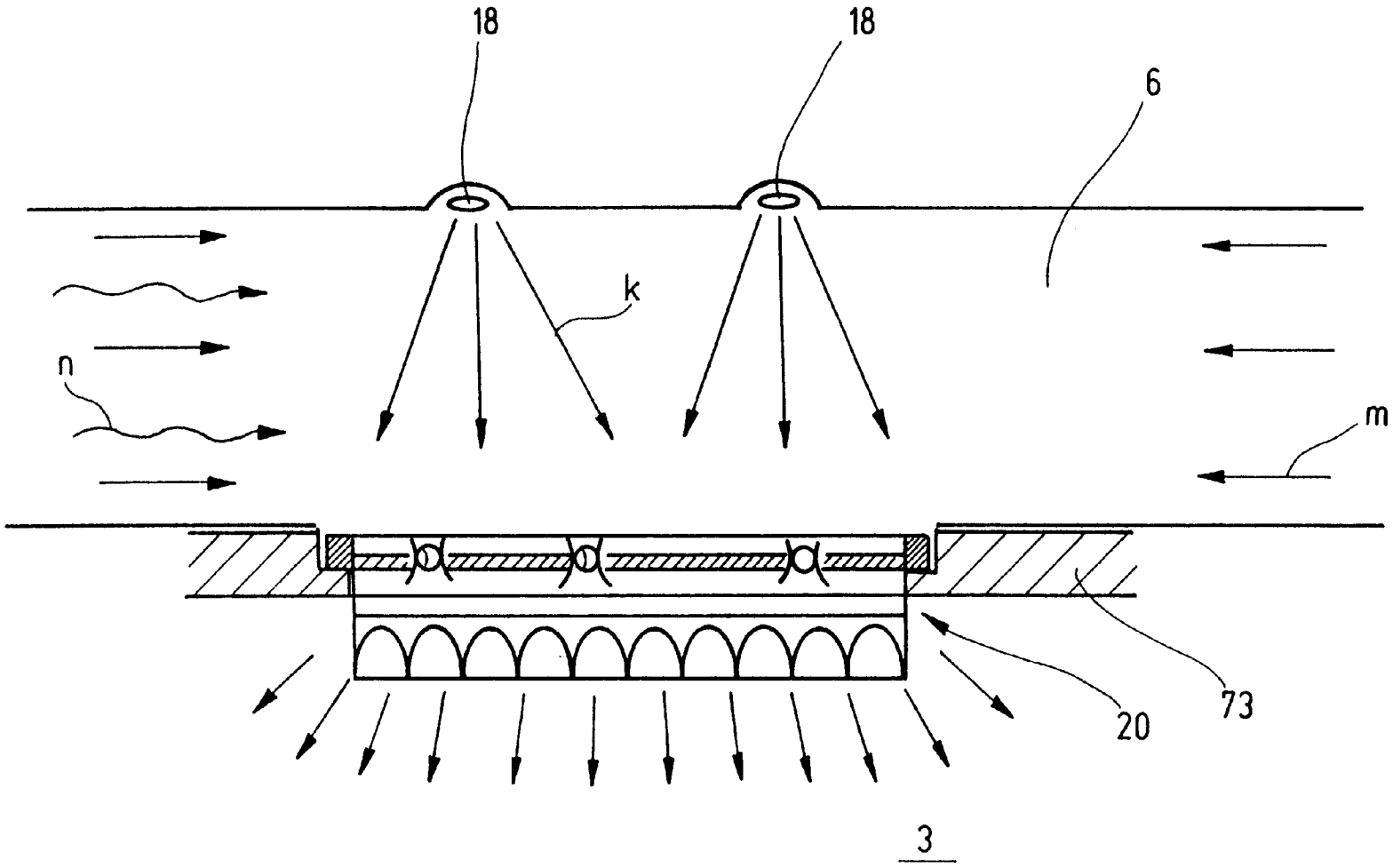
FIG. 18 shows a fourth embodiment of a combined air port for air and light.

FIG. 18 shows details of the air/light port 20 of FIG. 17 installed in a ceiling 73 of the room 3, together with the duct 6 lying above it. In contrast to the embodiment shown in FIG. 17, the upper wall of the duct 6 is provided with sources of artificial light 18, for instance halogen lamps or discharge lamps. As a result, light is fed from the duct 6, which light may be artificial light and/or daylight, and in addition the sources of artificial light 18 additionally feed light to the immediate vicinity of the air/light port 20.

Figure 19:
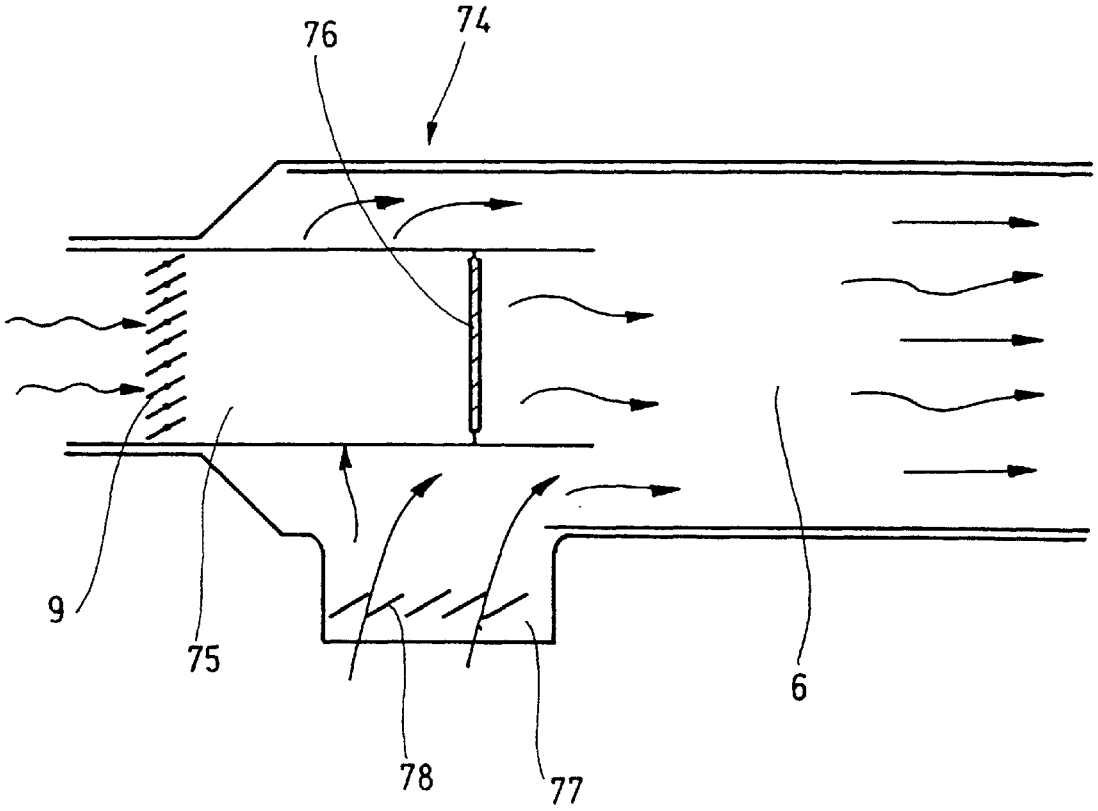
FIG. 19 shows a fifth embodiment of a combination device for air and light.

Finally, FIG. 19 shows a combination device 74 for transmitting air and light. The light, which may be artificial light or daylight, passes by means of the light-feed duct 75 into a duct 6 of larger cross section. The light-feed duct 75 is preferably arranged centrally in the duct 6. The light-feed duct preferably has a hinged mirror or light flap 9 in order to be able to control brightness. Adjoining this is a glass pane 76 for preventing entry of air from the duct 6. On the circumferential region of the duct 6, at the height of the end of the feed duct 75, there is an air feed 77 which may be provided with an air flap 78. The air fed passes into the duct 6. The feed of air can be developed so that the air surrounding the air-feed duct 75 enters the duct 6.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for conducting and distributing air and light in a structure, comprising:

conducting air and light along a common transport duct in the structure;

passing the air from the transport duct through a common port along the transport duct into the structure; and passing light out of the duct through the common port into the structure.

2. The method of claim 1, wherein the air is conducted in a transport direction and the light is directed to travel in the same direction as the transport direction of the air.

3. The method of claim 1, wherein the air is conducted in a transport direction and the light is directed to travel in opposite the direction to the transport direction of the air.

4. The method of claim 1, wherein light is directed from a source and the source of light is daylight.

5. The method of claim 1, wherein light is directed from a source and the source of light is artificial light.

6. The method of claim 1, wherein the air is conducted along the transport duct by natural air movement.

7. The method of claim 1, wherein the air is conducted along the transport duct by being mechanically moved therealong.

8. The method of claim 1, further comprising variably controlling the amount of air conducted through the transport duct.

9. The method of claim 1, further comprising variably controlling the amount of light conducted through the transport duct.

10. Apparatus for conducting/distributing air and light in a structure, the apparatus comprising:

a duct for transmitting air therethrough and also being adapted to conduct light through the duct; and a common air and light port in the duct communicating into the structure, the duct being adapted for air to pass from the duct through the port into the structure and for light to pass out of the duct through the port and into the structure.

11. The apparatus of claim 10, further comprising means communicating with the duct for moving air out of the duct through the port.

12. The apparatus of claim 10, further comprising means communicating with the duct for drawing air out through the port and into the duct.

13. The apparatus of claim 10, further comprising a single inlet into the duct for both air and light.

14. The apparatus of claim 10, further comprising respective separate inlets into the duct for air and light.

15. The apparatus of claim 9, wherein the duct has a light inlet at one end and at least one mirror within the duct supported for being repositioned to control the amount of light directed along the duct to the port.

16. The apparatus of claim 10, further comprising a plurality of the ducts each having a respective port therein and a common duct joining the plurality of ducts and for communicating air within all of the ducts and directing light through at least some of the ducts.

17. The apparatus of claim 10, further comprising an inlet through which air and/or light enters the duct from a source outside the structure.

18. The apparatus of claim 10, wherein the duct has one end and an air inlet at the one end, at least one flap within the duct supported for being repositioned to control the amount of air transmitted through the duct.

19. The apparatus of claim 11, further comprising an air treatment device for treating air to be moved out of the duct.

20. The apparatus of claim 19, wherein the air treatment device is at least one element selected from the group consisting of a filter, a heat exchanger, a humidifier, a dehumidifier, air circulation flaps, mixed-air flaps, and an air conditioner.

* * * * *